US009102892B2

(12) United States Patent
Dohi et al.

(10) Patent No.: US 9,102,892 B2
(45) Date of Patent: Aug. 11, 2015

(54) METHOD FOR PREPARING COAL FOR COKE MAKING

(75) Inventors: Yusuke Dohi, Fukuyama (JP); Izumi Shimoyama, Kurashiki (JP); Kiyoshi Fukada, Fukuyama (JP); Tetsuya Yamamoto, Fukuyama (JP); Hiroyuki Sumi, Kawasaki (JP)

(73) Assignee: JFE STEEL CORPORATION, Tokyo (JP)

( * ) Notice: Subject to any disclaimer, the term of this patent is extended or adjusted under 35 U.S.C. 154(b) by 307 days.

(21) Appl. No.: 13/820,255

(22) PCT Filed: Aug. 31, 2011

(86) PCT No.: PCT/JP2011/070311

§ 371 (c)(1),
(2), (4) Date: Jun. 7, 2013

(87) PCT Pub. No.: WO2012/029983

PCT Pub. Date: Mar. 8, 2012

(65) Prior Publication Data

US 2013/0255142 A1 Oct. 3, 2013

(30) Foreign Application Priority Data

Sep. 1, 2010 (JP) ..... 2010-195617

(51) Int. Cl.
*C10L 5/26* (2006.01)
*C10B 57/06* (2006.01)
(Continued)

(52) U.S. Cl.
CPC . *C10L 5/26* (2013.01); *C10B 57/04* (2013.01); *C10B 57/06* (2013.01); *C10B 57/08* (2013.01)

(58) Field of Classification Search
CPC ..... C10L 5/26; C10B 57/06; C10B 57/08
See application file for complete search history.

(56) References Cited

U.S. PATENT DOCUMENTS 4,259,083 A 3/1981 Ignasiak
7,846,301 B2 * 12/2010 Katou et al. ..... 201/6
(Continued)

FOREIGN PATENT DOCUMENTS

JP A-06-347392 12/1994
JP B2-2855728 2/1999
(Continued)

OTHER PUBLICATIONS

Morotomi et al., *Journal of the Fuel Society of Japan*, vol. 53, pp. 779-790, 1974 (With English-language Abstract).
(Continued)

*Primary Examiner* — Cephia D Toomer
(74) *Attorney, Agent, or Firm* — Oliff PLC

(57) ABSTRACT

A method for estimating the thermal plasticity of coal and a caking additive by observing the thermal plasticity of coal and a caking additive under the condition that sufficiently simulates an environment surrounding thermal plastic coal and a caking additive in a coke oven and to provide a method for preparing coal of a brand having a specified quality by making clear the required quality of a coal brand which can be ideally used for manufacturing high-strength coke by using the estimation method. A method for preparing coal for coke making, the method including adjusting a permeation distance of one or more kinds of coal to a specified value or less when plural coal brands are blended as materials to be used for coke making is used.

13 Claims, 4 Drawing Sheets

(51) Int. Cl.
*C10B 57/08* (2006.01)
*C10B 57/04* (2006.01)

(56) References Cited

U.S. PATENT DOCUMENTS

| | | | | |
|---|---|---|---|---|
| 2013/0255142 | A1* | 10/2013 | Dohi et al. | 44/550 |
| 2014/0144071 | A1* | 5/2014 | Dohi et al. | 44/607 |

FOREIGN PATENT DOCUMENTS

| | | |
|---|---|---|
| JP | A-2000-304674 | 11/2000 |
| JP | A-2007-161955 | 6/2007 |
| JP | A-2009-204609 | 9/2009 |

OTHER PUBLICATIONS

Miyazu et al., "The Blending Design Using Many Kinds of Coal and the Evaluation System for Single Coal," *Nippon Kokan Technical Report*, vol. 67, pp. 125-137, 1975 (With English-language Abstract).
International Search Report issued in Application No. PCT/JP2011/070311; Dated Dec. 6, 2011 (With Translation).
Alvarez et al., "Influence of Coal Weathering on Coke Quality", Ironmaking & Steelmaking, vol. 30, No. 4, Aug. 1, 2003, pp. 307-312.
Maton, "Unit Train Loading Systems-Reclaimer Selection and Wagon Weighing", Bulk Solids Handling 2005 Trans Tech Publications, vol. 25, 2005, pp. 30-35.
May 8, 2015 Search Report issued in European Application No. 11821993.0.

* cited by examiner

METHOD FOR PREPARING COAL FOR COKE MAKING

TECHNICAL FIELD

The present invention relates to a method for preparing coal for coke making in which coke strength can be increased on the basis of the estimation results of coal for coke making by using a testing method which precisely estimates the thermal plasticity of coal when carbonization is performed.

BACKGROUND ART

Coke, which is used in a blast furnace method which is the most common method for manufacturing pig iron, has roles as a reducing agent of iron ore, a heat resource and a spacer. As it is important to keep gas permeability in a blast furnace in order to operate a blast furnace steadily and efficiently, the manufacture of coke having high strength is desired. Coke is manufactured by carbonizing a coal blend, which is made by blending various kinds of coal for coke making which are pulverized and whose particle size has been adjusted, in a coke oven. Coal for coke making softens and melts at a temperature in the range from 300° C. to 550° C. when carbonization is performed, and, at the same time, foams and swells due to the generation of volatile matter, which results in the particles of the coal adhering to each other so that the coal is made into agglomerated semi-coke. Then, the semi-coke is made into strong coke by being made denser in a process in which the semi-coke is heated up to a temperature of about 1000° C. and shrinks. Therefore, the adhesiveness of coal when softening and melting occur has a large influence on the properties of coke such as strength and particle size after carbonization has been performed.

As the properties and the cake structure of coke widely vary depending on the thermal plasticity of coal after carbonization has been performed as described above, the thermal plasticity of coal is so important that investigations on a method observing the thermal plasticity have been actively conducted since long ago. In particular, coke strength, which is an important property of coke, widely varies depending on the properties of coal, which is the raw material of coke, especially on coal rank and thermal plasticity. Thermal plasticity is the quality of softening and melting when coal is heated, and is usually estimated by observing the fluidity, the viscosity, the adhesiveness, the swelling property and so forth of a thermal plastic material.

The examples of common methods for observing fluidity when softening and melting occur, which is a kind of thermal plasticity, include a method for testing fluidity of coal by using a Gieseler plastometer method in accordance with JIS M 8801. A Gieseler plastometer method is a method in which coal is pulverized into a particle size of 425 μm or less, then the pulverized coal is put into a specified retort and heated at a specified heating rate, and then the rotational velocity of a stirring stick on which the specified torque is applied is observed on a scale plate and represented in units of ddpm (dial divisions per minute).

While the rotational velocity is observed for a constant torque in a Gieseler plastometer method, a method in which a torque is observed for a constant rotational velocity has also been developed. For example, Patent Literature 1 discloses a method in which a torque is observed while a rotator is rotating at a constant rotational velocity.

In addition, there is a method for observing viscosity by using a dynamic viscoelasticity observing machine in order to observe viscosity, which has a physical meaning, as thermal plasticity (for example, refer to Patent Literature 2). A viscoelastic behavior is observed when a cyclic force is applied to a viscoelastic body in the observation of dynamic viscoelasticity. Patent Literature 2 discloses a method in which thermal plasticity is estimated in terms of complex viscosity among observed parameters and which is characterized in that the viscosity of a thermal plastic coal can be observed at an arbitrary shear rate.

Moreover, an example, in which adhesiveness of the softening coal to activated carbon or glass beads is observed as thermal plasticity of coal, has been reported. This is a method in which activated carbon or glass beads are put on the upper and lower surfaces of a small amount of a coal sample, then the sample is heated, then cooled after softening and melting has occurred, and then the adhesiveness of the coal sample to activated carbon or glass beads is observed from the appearance.

An example of common methods for observing the swelling property of coal when softening and melting occurs is a dilatometer method in accordance with JIS M 8801. A dilatometer method is a method in which coal is pulverized into a particle size of 250 μm or less, then the pulverized coal is compacted in a specified method, put into a specified retort and heated at a specified heating rate, and then the time change in the displacement of the coal is observed by using a detection stick which is placed on top of the coal.

Moreover, a method for testing the swelling property of coal, in which the permeation behavior of gas which is generated when softening and melting occur is improved in order to simulate the thermal plastic behavior of coal in a coke oven, is well known (for example, refer to Patent Literature 3). This is a method in which the observation environment is made closer to one in which swelling behavior is observed in a coke oven by placing a permeable material between a coal layer and a piston, or between a coal layer and a piston and under the coal layer in order to increase the number of permeation channels for volatile matter and liquid material which are generated from coal. Similarly, a method for observing the swelling property of coal, by placing a material having channels permeating through the body on top of a coal layer and by heating the coal with microwaves while a load is applied to the coal, is well known (refer to Patent Literature 4).

CITATION LIST

Patent Literature

[PTL 1] Japanese Unexamined Patent Application Publication No. 6-347392

[PTL 2] Japanese Unexamined Patent Application Publication No. 2000-304674

[PTL 3] Japanese Patent No. 2855728

[PTL 4] Japanese Unexamined Patent Application Publication No. 2009-204609

Non Patent Literature

[NPL 1] Morotomi et al.: "Journal of the Fuel Society of Japan", Vol. 53, 1974, pp. 779-790

[NPL 2] Miyazu et al.: "Nippon Kokan Technical Report", Vol. 67, 1975, pp. 125-137

DISCLOSURE OF INVENTION

Problems to be Solved by the Invention

Generally, a coal blend which is made by blending plural brands of coal at specified ratios is used for manufacturing metallurgical coke, and there is a problem in that it is impossible to achieve desired coke strength in the case where thermal plasticity cannot be correctly estimated. In the case where coke having low strength which does not have the desired strength is used in a shaft furnace of a blast furnace type, there is a possibility of causing a trouble in that the amount of powder which is generated in the shaft furnace is increased, which results in instability in the operation of the shaft furnace due to an increase in pressure loss, and which results in so-called blow-by in which gas flow locally concentrates.

There are many examples of the indicators of thermal plasticity, by using which it is impossible to exactly predict strength. Therefore, coke strength is controlled to a certain value or more on an empirical basis by setting a target of coke strength rather high in advance in consideration of the variability of coke strength due to inaccuracy in the estimation of thermal plasticity. However, this method causes an increase in cost, because the average quality of a coal blend is set rather high by using coal which is commonly known to have good thermal plasticity and to be comparatively expensive.

Thermal plastic coal is softening and melting in a coke oven under a condition in which the coal is constrained by adjacent layers. As the thermal conductivity of coal is so small that coal is not uniformly heated in a coke oven, there are layers of different conditions such as, from the side of the furnace wall, a coke layer, a plastic layer and a coal layer. Thermal plastic coal is constrained by adjacent coke layer and coal layer, because, although a coke oven expands a little when carbonization is performed, the amount of deformation is negligible.

Moreover, around thermal plastic coal, there are many kinds of defective structures such as spaces between particles in a coal layer, spaces between particles in a thermal plastic coal layer, large pores caused by volatilization of pyrolysis gas and cracks occurring in an adjacent coke layer. In particular, the width of a crack occurring in a coke layer is thought to be from several hundred μm to several mm and is larger than that of a space between coal particles or a pore which is from several dozen to several hundred μm. Therefore, not only pyrolysis gas and fluid material which are generated from coal as by-product but also thermal plastic coal itself are thought to permeate into the large defect which occurs in a coke layer. In addition, it is expected that the shear rate applied on thermal plastic coal when permeation occurs will vary depending on coal brand.

The present inventors thought that it is necessary to use, as an indicator, thermal plasticity of coal which is observed under the condition that simulates the environment to which the coal is exposed in a coke oven as described above in order to control coke strength more precisely. In particular, the present inventors thought that it is important to observe thermal plasticity under a condition in which thermal plastic coal is constrained as well as under the condition that simulates the movement and the filtration of thermal plastic material into surrounding defective structures. However, there were the problems in the conventional observation method as descried below.

As a Gieseler plastometer method is an observing method in which coal is packed in a vessel, there is a problem in that constraint and permeation conditions are not considered. Moreover, this method is not suitable to the observation of coal having high fluidity. The reason for that is because, in the case of coal having high fluidity, a stirring stick idly rotates due to a phenomenon (Weissenberg effects) in which hollowing occurs in the vicinity of the side wall inside the vessel, which results in there being a case where it is impossible to correctly estimate fluidity (for example, refer to Non Patent Literature 1).

Similarly, in the case of observing torque with a constant rotational velocity, there is also an inadequacy in that constraint and permeation conditions are not considered. Moreover, as this method is an observation with a constant shear velocity, it is impossible to correctly estimate the thermal plasticity of coal as described above.

A dynamic viscoelasticity observing apparatus is an apparatus by using which viscosity is observed as thermal plasticity and by using which viscosity can be observed with an arbitrary shear velocity. Therefore, it is possible to observe the viscosity of thermal plastic coal in a coke oven, if a shear velocity when observation is performed is set to the value for that which is applied to coal in a coke oven. However, it is usually difficult to observe or to predict the shear velocity which is applied to each brand of coal in a coke oven.

In the case of a method in which the adhesiveness of coal to activated coal or glass beads is observed as thermal plasticity of coal, although the simulation of filtration conditions in the presence of coal is intended, there is a problem in that a coke layer or a large defect is not considered. Moreover, there is also an inadequacy in that observation is not performed under constraint conditions.

In the case of a method for testing the swelling property of coal utilizing permeable material according to Patent Literature 3, although the movement of gas and liquid material which are generated from coal are considered, there is a problem in that the movement of thermal plastic coal itself is not considered. This is because the permeability of the permeable material which is used in Patent Literature 3 is not large enough for thermal plastic coal to move. When the present inventors conducted the test according to Patent Literature 3, the permeation of thermal plastic coal into a permeable material did not occur. Therefore, it is necessary to consider new conditions in order to make the permeation of thermal plastic coal into a permeable material occur.

Although Patent Literature 4 also discloses a method for testing the swelling property in which the movement of gas and liquid material which are generated from coal are considered by similarly placing a material having channels permeating through the body on top of a coal layer, there are problems not only in that there is a restriction on a heating method but also in that the conditions of estimating permeation phenomenon in a coke oven are not clear. Moreover, it cannot be said that Patent Literature 4 discloses a method for manufacturing coke of satisfactory quality, because the relationship between the permeation phenomenon and the thermal plastic behavior of thermal plastic coal is not made clear, and because there is no suggestion on the relationship between the permeation phenomenon of thermal plastic coal and the quality of coke.

As described above, by using conventional methods, it is impossible to observe thermal plasticity of coal and a caking additive such as fluidity, viscosity, adhesiveness, permeability, swelling ratio when permeation occurs and pressure when permeation occurs under the condition that sufficiently simulates an environment surrounding thermal plastic coal and a caking additive in a coke oven.

Therefore, an object of the present invention is, by solving the problems in the conventional methods described above, to provide a method for more precisely estimating the thermal plasticity of coal by observing the thermal plasticity of coal under the condition that sufficiently simulates an environment surrounding thermal plastic coal in a coke oven and to provide a method for preparing coal of a brand having a specified quality by making clear the quality of a coal brand which can be ideally used for manufacturing high-strength coke by using the estimation method.

Solution to Problem

The characteristics of the present invention for solving the problems described above will be described below.

[1] A method for preparing coal for coke making, the method including adjusting a permeation distance of an individual coal brand to a specified value or less when the coal brand is prepared as a material to be used for coke making by itself or by being blended with other coal brands.

[2] A method for preparing coal for coke making, the method including adjusting a permeation distance of one or more coal brands to a specified value or less when plural coal brands are blended as a material to be used for coke making.

[3] A method for preparing coal for coke making according to item [1] or [2], the method including adjusting the Gieseler maximum fluidity of the coal brand to 100 ddpm or more.

[4] A method for preparing coal for coke making according to any one of items [1] to [3], the method comprising defining the specified value of the permeation distance of the coal brand to be prepared by the following equation (1):

$$\text{permeation distance}=1.3\times a\times\log MFc \quad (1),$$

where a is a constant that is 0.7 to 1.0 times a coefficient of log MF obtained by measuring the permeation distance and log MF of at least one of coals that satisfy log MF<2.5 and making a regression line that passes through the origin using the measured values, and where MFc is the Gieseler maximum fluidity (ddpm) of the coal to be prepared.

[5] A method for preparing coal for coke making according to item [4], wherein the a is a constant that is 0.7 to 1.0 times a coefficient of log MF obtained by measuring the permeation distance and log MF of at least one of coals that satisfy 1.75<log MF<2.50 and making a regression line that passes through the origin using the measured values.

[6] A method for preparing coal for coke making according to any one of items [1] to [3], the method comprising defining the specified value of the permeation distance of the coal brand to be prepared by the following equation (2):

$$\text{permeation distance}=a'\times\log MFc+b \quad (2),$$

where a' is a constant that is 0.7 to 1.0 times a coefficient of log MF obtained by measuring the permeation distance and log MF of at least one of coals that satisfy log MF<2.5 and making a regression line that passes through the origin using the measured values, where b is a constant defined by the mean value of a standard deviation of a permeation distance or more and the mean value multiplied by 5 or less, when observation is performed plural times for the same sample of one or more kinds selected from the coal brands which are used for deriving the regression line, and where MFc is the Gieseler maximum fluidity (ddpm) of the coal to be prepared.

[7] A method for preparing coal for coke making according to item [6], the a' being a constant that is 0.7 to 1.0 times a coefficient of log MF obtained by measuring the permeation distance and log MF of at least one of coals that satisfy 1.75<log MF<2.50 and making a regression line that passes through the origin using the measured values.

[8] A method for preparing coal for coke making according to any one of items [1] to [3], wherein the specified value of the permeation distance is 15 mm according to a value observed when a sample of the coal prepared by pulverizing the coal so that particles having a diameter of 2 mm or less account for 100 mass % and packing a vessel with the pulverized coal at a packing density of 0.8 g/cm$^3$ to a layer thickness of 10 mm is heated to 550° C. at a heating rate of 3° C./min while a load is applied from above glass beads having a diameter of 2 mm placed on the sample so that the pressure is 50 kPa and observing a permeation distance of a thermal plastic sample into the glass beads.

[9] A method for preparing coal for coke making according to any one of items [1] to [3], the method including determining plural kinds of coal constituting a coal blend in advance and setting the specified permeation distance to be the mean value of the permeation distance of these kinds of coal multiplied by 2 or more.

[10] A method for preparing coal for coke making according to any one of items [1] to [9], the method including adjusting the permeation distance of individual coal brands to be prepared by blending plural kinds of coal from different places of production.

[11] A method for preparing coal for coke making according to any one of items [1] to [9], the method including a treatment for decreasing the permeation distance of coal by placing the coal in an atmosphere consisting of one or more of $O_2$, $CO_2$ and $H_2O$ at a temperature of room temperature or higher.

[12] A method for preparing coal for coke making according to item [11], the treatment being performed at a treatment temperature of 100° C. or higher and 300° C. or lower for a treatment time of 1 minute or more and 120 minutes or less.

[13] A method for preparing coal for coke making according to item [12], the treatment being performed at a treatment temperature of 180° C. or higher and 200° C. or lower for a treatment time of 1 minute or more and 30 minutes or less.

Advantageous Effects of Invention

According to the present invention, coal which can be ideally used for manufacturing high-strength metallurgical coke can be prepared by using an observed value that enables estimation of the thermal plasticity of coal, that is to say, by using a permeation distance of a thermal plastic material into a defective structure which is observed under the condition that simulates the influence of a defective structure surrounding a plastic layer of coal in a coke oven, in particular, of a crack existing in a coke layer adjacent to the plastic layer, and that appropriately simulates a constraint condition surrounding a thermal plastic material in a coke oven.

DESCRIPTION OF EMBODIMENTS

Generally, coke is manufactured by carbonizing coal blend which is manufactured by blending plural coal brands of varing quality. Coal is usually shipped after the quality of each brand has been adjusted so as to satisfy the quality standard specified by a purchasing contract and so forth at a coal mining area. The quality is restricted by the quality of mined coal, and, even if coal is mined from the same coal mine, the quality of the coal depends on the mining location and the treatment performed after mining and is not always the same.

The present inventors found that a "permeation distance", which has become possible to observe by a new observing method, and which is a new estimation indicator of thermal plasticity, is an indicator superior to conventional indicators for controlling coke strength. Then, from the results of investigations on a method for preparing a material coal brand having thermal plasticity which is judged to be preferable by using a new estimation method, it was found that it is possible to prepare coal having preferable properties by combining coal brands having different properties and by performing an ideal treatment on coal, and, consequently, the present invention has been completed. The outline of the observation of a "permeation distance" will be described hereafter.

Figure 1:
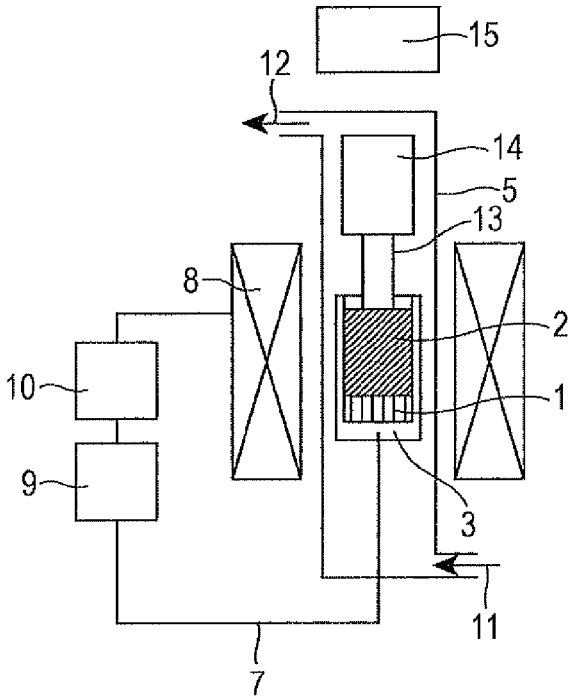
FIG. 1 is a schematic diagram illustrating an example of an apparatus for observing thermal plasticity with a constant load being exerted on a sample to be used in the present invention and a material having through-holes from the top to the bottom.
Figure 8:
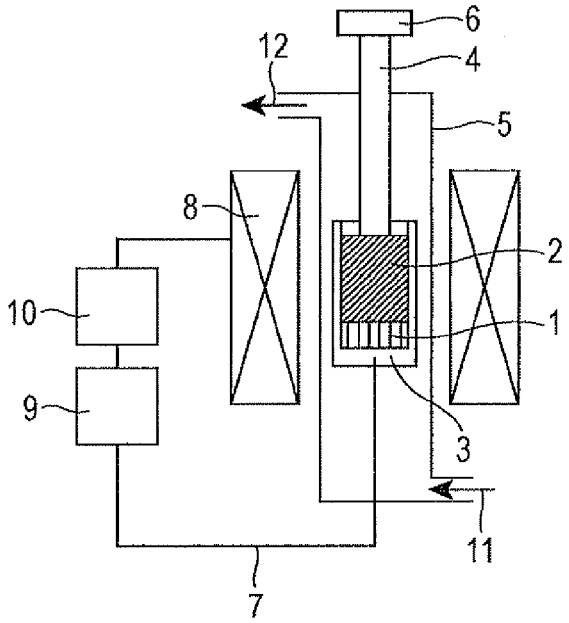
FIG. 8 is a schematic diagram illustrating an example of an apparatus for observing thermal plasticity with a volume being kept constant for a sample according to the present invention and a material having through-holes from the top to the bottom.

FIG. 1 illustrates an example of an apparatus for observing thermal plasticity (a permeation distance) according to the present invention. FIG. 1 illustrates an apparatus in the case where a coal sample is heated with a constant load being exerted on the coal and a material having through-holes from the top to the bottom. A sample 1 is made by packing coal into the bottom of a vessel 3, and then a material 2 having through-holes from the top to the bottom is placed on top of the sample 1. The sample 1 is heated up to a temperature, at which the sample begins to soften and to melt, or higher so that the sample 1 permeates into the material 2 having through-holes from the top to the bottom, and then the permeation distance is observed. Heating is performed in an inert gas atmosphere. Here, an inert gas refers to a gas which does not react with coal at a temperature in a range in which observation is performed, and representative examples of an inert gas include argon gas, helium gas and nitrogen gas. The permeation distance may be observed under a condition in which heating is performed with the volume of coal and a material having through-holes from the top to the bottom being kept constant. FIG. 8 illustrates an example of an apparatus for observing thermal plasticity (a permeation distance) in that case.

In the case where heating is performed with a constant load being exerted on the sample 1 and the material 2 having through-holes from the top to the bottom, the sample 1 exhibits swells or shrinks and the material 2 having through-holes from the top to the bottom moves vertically. Therefore, it is possible to observe a swelling ratio through the material 2 having through-holes from the top to the bottom when permeation occurs. As FIG. 1 illustrates, a detection stick 13 used for determining the swelling ratio is placed on top of the material 2 having through-holes from the top to the bottom, a weight 14 for exerting a load on the sample is placed on top of the detection stick 13 used for determining the swelling ratio, a displacement sensor 15 is placed on top of the weight 14, and then the swelling ratio is observed. It is appropriate to use a displacement sensor 15 which can observe the swelling ratio in the swelling range of the sample (from −100% to 300%). It is preferable that an optical displacement sensor be used, because a displacement sensor of non-contact type is suitable for the case where it is necessary that the inside of a heating system be kept in an inert gas atmosphere. It is preferable that a nitrogen atmosphere be used as an inert gas atmosphere. In the case where the material 2 having through-holes from the top to the bottom has a layer packed with spherical particles, it is preferable that a plate be placed between the material 2 having through-holes from the top to the bottom and the detection stick 13 used for determining the swelling ratio, because there is a possibility that the detection stick 13 used for determining the swelling ratio may become buried in the layer of particles. As for the load to be exerted on the sample, it is preferable that the load be uniformly exerted on top of the material having through-holes from the top to the bottom and that a pressure of from 5 kPa to 80 kPa be exerted on the area of the top surface of the material having through-holes from the top to the bottom, more preferably from 15 kPa to 55 kPa, most preferably from 25 kPa to 50 kPa. Although it is preferable that this pressure is set on the basis of the swelling pressure of a plastic layer in a coke oven, from the results of investigations on the repeatability of observation results and on the detection power of the difference between various coal brands, it has been found that a pressure of about from 25 kPa to 50 kPa, which is rather higher than the swelling pressure in a practical coke oven, is the most preferable as an observation condition.

As for a heating means, it is preferable to use a means such that heating can be performed at a specified heating rate with the temperature of the sample being observed. The specific examples include an electric furnace, an external heating system which combines an electrically conductive vessel and a high frequency induction unit and an internal heating system such as microwave heating. In the case where an internal heating system is applied, some device is necessary in order to achieve a uniform temperature distribution in the inside of the sample, and, for example, it is preferable to take measures to increase the thermal insulation properties of the vessel.

As for the heating rate, it is necessary that the heating rate be equal to the heating rate for coal in a coke oven in order to simulate the thermal plastic behavior of coal and a caking additive in a coke oven. As a heating rate for coal in a temperature range for thermal plasticity varies depending on a position in a coke oven and operation conditions and is about from 2° C./rain to 10° C./min, it is preferable that the simulation heating rate be from 2° C./min to 4° C./min which is nearly the mean value of a practical heating rate, more preferably about 3° C./min. However, in the case of coal having low fluidity such as non or slightly caking coal, there is the possibility that the permeation distance and swelling for a heating rate of 3° C./min are too small to be detected. It is well known that the fluidity of coal observed by using a Gieseler plastometer is increased by performing heating at a high heating rate. Therefore, for example, in the case of coal the permeation distance of which is 1 mm or less, observation may be performed at a rather higher heating rate of from 10° C./min to 1000° C./min in order to increase detection sensitivity.

As for the temperature range for heating, it is appropriate that heating be performed in a temperature range for thermal plasticity, because the object of observation is to estimate the thermal plasticity of coal and a caking additive. It is appropriate, in consideration of the temperature range for thermal plasticity of coal for coke making and a caking additive, that heating be performed at a temperature in the range of from 0° C. (room temperature) to 550° C. at a specified heating rate, preferably from 300° C. to 550° C. which is a temperature range for thermal plasticity of coal.

Figure 2:
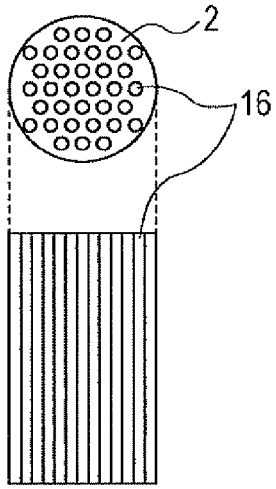
FIG. 2 is a schematic diagram illustrating an example of a material having through-holes from the top to the bottom to be used in the present invention which has circular through-holes permeating through the body.
Figure 3:
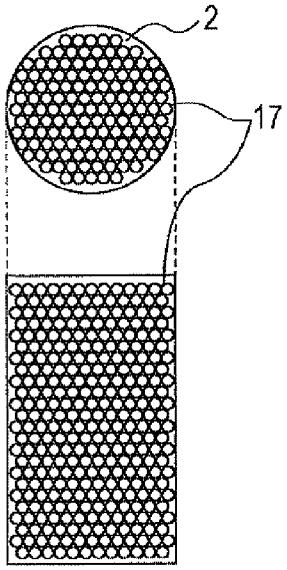
FIG. 3 is a schematic diagram illustrating an example of a material having through-holes from the top to the bottom to be used in the present invention which has a layer packed with spherical particles.
Figure 4:
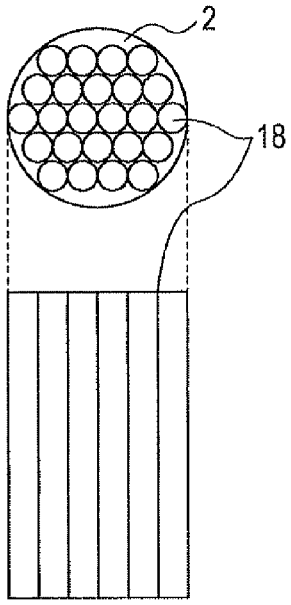
FIG. 4 is a schematic diagram illustrating an example of a material having through-holes from the top to the bottom to be used in the present invention which has a layer packed with cylindrical bodies.

It is preferable that the permeability coefficient of a material having through-holes from the top to the bottom be observed or calculated in advance. The examples of the form of the material include a one-body material having through-holes through the body and a layer packed with particles. Examples of a one-body material having through-holes through the body include a material having circular holes 16 permeating through the body as illustrated in FIG. 2, a material having rectangular holes permeating through the body and a material having irregularly shaped holes permeating through the body. Examples of the layer packed with particles are roughly classified into a layer packed with spherical particles and a layer packed with non-spherical particles. Examples of the layer packed with spherical particles include one packed with packing particles 17 of beads as illustrated in FIG. 3 and examples of a layer packed with non-spherical particles include one packed with irregularly shaped particles and one packed with packing cylinders 18 as illustrated in FIG. 4. It is preferable that the permeability coefficient of a material be as uniform as possible in order to achieve repeatability of observation and that the calculation of the permeability coefficient be easy in order to achieve the convenience of observation. Therefore, it is preferable that a layer packed with spherical particles be used as a material having through-holes from the top to the bottom. There are no particular limitations regarding what material is selected as a material having through-holes from the top to the bottom as long as the material negligibly deforms and does not react with coal at a temperature in a temperature range for thermal plasticity of coal, specifically 600° C. or lower. In addition, it is preferable that the height of the material be sufficiently high so as to allow molten coal to permeate the material, and, in the case where a coal layer having a thickness of from 5 mm to 20 mm is heated, it is appropriate that the height of the material be about from 20 mm to 100 mm.

It is necessary that the permeability coefficient of a material having through-holes from the top to the bottom be set on the basis of the estimated value of the permeability coefficient of a large defect existing in a coke layer. The present inventors conducted investigations on what value of the permeability coefficient is particularly preferable for the present invention, including examination on the configuration factor of a large defect and estimation of the size of a large defect, and, as a result, found that the case where a permeability coefficient is from $1\times10^8$ $m^{-2}$ to $2\times10^9$ $m^{-2}$ is ideal. This permeability coefficient is derived on the basis of Darcy's law which is expressed by equation (3) described below.

$$\Delta P/L=K\cdot\mu\cdot u \quad (3),$$

where ΔP denotes a pressure loss in a material having through-holes from the top to the bottom [Pa], L denotes the height of the material [m], K denotes the permeability coefficient [$m^{-2}$], μ denotes the viscosity of a fluid [Pa·s] and u denotes the velocity of a fluid [m/s]. For example, in the case where a layer packed with glass beads having a constant particle size is used as a material having through-holes from the top to the bottom, it is preferable to select glass beads having a diameter of about from 0.2 mm to 3.5 mm, most preferably 2 mm.

Coal and a caking additive to be used for a sample for observation are pulverized in advance, and then are compacted so as to a specified packing density and a specified thickness. Although the size of the pulverized particles may be set to be equivalent to the size of coal to be charged into a coke oven (the proportion of particles having a particle size of 3 mm or less with respect to the total amount of particles is about from 70 mass % to 80 mass %), and although it is preferable that pulverization be performed so that the proportion of particles having a particle size of 3 mm or less with respect to the total amount of particles is 70 mass % or more, it is particularly preferable to use a pulverized material which consists only of particles having a particle size of 2 mm or less, in consideration that observation is performed in a small apparatus. Although the packing density of the pulverized material may be set to be from 0.7 to 0.9 g/$cm^3$ in accordance with the packing density in a coke oven, from the results of investigations on repeatability and detection power, it has been found that it is preferable to set the packing density of the pulverized material to be 0.8 g/$cm^3$. In addition, although a packing thickness may be set to be from 5 mm to 20 mm on the basis of the thickness of a thermal plastic layer in a coke oven, from the results of investigations on repeatability and detection power, it has been found that it is preferable to set the packing thickness to be 10 mm.

The representative conditions of the observation of a permeation distance described above are as follows:

(1) coal or a caking additive is pulverized so that the proportion of particles having a particle size of 2 mm or less with respect to the total amount of particles is 100 mass %, then a sample is made by packing the pulverized coal or a caking additive with a packing density of 0.8 g/$cm^3$ and a thickness of 10 mm, then (2) glass beads having a diameter of 2 mm are placed on top of the sample with a thickness equal to a permeation distance or more (usually a thickness of 80 mm), then (3) the sample is heated from room temperature to 550° C. at a heating rate of 3° C./min in an inert gas atmosphere with a load of 50 kPa being exerted on top of the glass beads, and then (4) the permeation distance of a molten sample into the glass beads is observed.

It is originally preferable that the permeation distance of the thermal plastic material of coal and a caking additive be always observed continuously. However, continuous observation is difficult because of the influence of tar which is generated from a sample. Swelling and permeation phenomenon of coal caused by heating are irreversible, and, once swelling and permeation occur, the shapes formed by swelling and permeation is kept even after cooling has been performed. Therefore, it is acceptable to cool the whole vessel after permeation of molten coal has finished and to estimate how far molten coal permeated when heating was performed by observing a permeation distance after cooling has been performed. For example, it is possible to extract a material having through-holes from the top to the bottom from the vessel after cooling has been performed and to directly measure a permeation distance by using a vernier micrometer or a ruler. In addition, in the case where, particles are used as a material having through-holes from the top to the bottom, a thermal plastic material which has permeated into pores between the particles makes all of the particles in the permeated portion adhere to each other. Therefore, the mass of the particles which adhere to each other can be derived as a difference between the original mass of the layer packed with particles and the particles which do not adhere to each other after permeation has been finished, then, if the relationship between the mass and the height of a layer packed with particles is obtained in advance, a permeation distance can be calculated from the mass of the particles which adhere to each other.

The advantage of a permeation distance described above is not only assumed in principle on the basis of the method for observing in which the conditions in a coke oven are simulated but also clarified by the investigation results on influence of a permeation distance on coke strength. In fact, by using the estimation method according to the present invention, it has been clarified that there is a difference in a permeation distance between coal brands having nearly equal values of log MF (the common logarithm of the Gieseler maximum fluidity) and it has been confirmed that, in the case where coke is manufactured by blending coal brands having different permeation distances, there is an influence of different permeation distances on coke strength.

It has been thought that coal having higher fluidity is more effective for making coal particles adhere to each other on the basis of the estimation of thermal plasticity observed by using a conventional Gieseler plastometer. On the other hand, from the results of investigations on the relationship between a permeation distance and coke strength, it was found that, in the case where coal having an excessively large permeation distance is blended, coke strength is lower than expected on the basis of a mean value of a coal blend, because large defects and a structure consisting of thin pore walls are formed when coke making is performed. That is presumed to be because coal particles having an excessively large permeation distance leave large pores at the place where the particles themselves existed by significantly permeating into the surrounding coal particles. In particular, it was found that the amount of the defects in coke left by coal having high fluidity on the basis of the estimation of thermal plasticity by using a Gieseler plastometer varies depending on the permeation distance of the coal. This relationship was similarly found for a caking additive.

From the results of diligent investigations by the present inventors, it was found that the ranges of permeation distance of coal and a caking additive, which cause a decrease in coke strength when the coal and the caking additive are blended in a material for coke making, are specified in 4 cases (a) through (d) as described below.

(a) The range of a permeation distance is to be specified by the following equation.

$$\text{permeation distance} > 1.3 \times a \times \log MFc,$$

where a is a constant defined by the coefficient of log MF multiplied by a value in the range of 0.7 or more and 1.0 or less, when a regression line with an intercept on the origin is drawn for the observed values of permeation distance and log MF of one or more kinds of coal and a caking additive the log MF of which is less than 2.5, and MFc is the Gieseler maximum fluidity (ddpm) of the coal the permeation distance of which is to be estimated.

(b) The range of a permeation distance is to be specified by the following equation.

$$\text{permeation distance} > a' \times \log MFc + b,$$

where a' is a constant defined by the coefficient of the common logarithm of a Gieseler maximum fluidity log MF multiplied by a value in the range of 0.7 or more and 1.0 or less, when a regression line with an intercept on the origin is drawn for the observed values of permeation distance and log MF of one or more kinds of coal and a caking additive the log MF of which is less than 2.5, where b is a constant defined by the mean value of a standard deviation of a permeation distance or more and the mean value multiplied by 5 or less, when observation is performed plural times for the same sample of one or more kinds selected from the coal brands which are used for deriving the regression line, and where MFc is the Gieseler maximum fluidity (ddpm) of the coal the permeation distance of which is to be estimated.

(c) A permeation distance is set to be more than a simple mean value of those of the coal brands contained in a coal blend multiplied by 2, in the case where the coal brands to be used for coke making can be determined in advance.

(d) A permeation distance is set to be more than 15 mm in terms of the observed permeation distance, by making a sample by pulverizing coal into a particle size of 2 mm or less and by packing the pulverized coal into a vessel with a packing density of 0.8 g/cm$^3$ and a thickness of 10 mm, then using glass beads having a diameter of 2 mm as a material having through-holes permeating through the body, then heating the sample at a heating rate of 3'C/min up to the temperature of 550° C. with a load of 50 kPa being exerted, and then observing a permeation distance of a thermal plastic sample into glass beads.

Here, the reason why the 4 kinds of methods (a) through (d) for determining the control value are described above is because it was found that a permeation distance varies depending on the set observation conditions such as a load, a heating rate, a kind of a material having through-holes permeating through the body and a configuration of an apparatus and that the methods (a) through (c) for determining the control value are effective from the results of investigations in consideration that there may be the cases of different conditions from those according to the present invention.

In addition, the constants a and a' which are respectively used for determining the range according to (a) and (b) are defined by the coefficient of log MF multiplied by a value in the range of 0.7 to 1.0, when a regression line with an intercept on the origin is drawn for the observed values of permeation distance and log MF of one or more kinds of coal the log MF of which is less than 2.5. That is because, although, in the range of log MF being less than 2.5, there is virtually a positive correlation between maximum fluidity and a permeation distance of coal, in the case of coal brand which causes a decrease in strength, a permeation distance significantly deviates positively from this correlation. The present inventors, from the results of diligent investigations, found that a coal brand corresponding to the range of 1.3 times or more the permeation distance which is determined in accordance with log MF of the coal brand by using the regression equation described above is a coal brand which causes a decrease in strength, and decided to specify the range according to (a). In addition, the present inventors found that a coal brand corresponding to the range of a permeation distance of more than the value which is determined by adding 1 to 5 times the standard deviation which is derived when observation is performed plural times for the same sample to the regression equation described above is a coal brand which causes a decrease in strength, and decided to specify the range as described in (b) in order to detect a coal brand which deviates positively from the correlation equation beyond an observation error. Therefore, it is appropriate that the value of 1 to 5 times the standard deviation which is derived when observation is performed plural times for the same sample is used as the constant b, and b is about from 0.6 mm to 3.0 mm under the observation conditions according to the present invention. Here, both equations determine the range of a permeation distance, a coal corresponding to which causes a decrease in strength, on the basis of the value of log MF of the coal. That is because, as, generally, a permeation distance is larger for a larger MF, it is important how far a permeation distance deviates from this correlation. Incidentally, a method for linear regression by a well-known least-square method may be used in order to make a regression line. It is preferable that the number of coal brands is as large as possible, because the more the number is, the less the error is. In particular, it is referable that a regression line be derived by using one or more coal brands in the range of log MF of more than 1.75 and less than 2.50, because a permeation distance for a coal brand of a small MF is small, which results in making error tend to become large.

The reason why the ranges of a, and b are specified is because a coal which causes a decrease in strength can be certainly detected by making these values smaller and because the values can be adjusted in accordance with operational requirement. However, if these values are made too small, there are problems in that too many kinds of coal are estimated as having a negative effect on coke strength and in that coal which does not cause a decrease in strength is mistaken for coal which causes a decrease in strength. Therefore, it is preferable that a and a' be set to be a slope of a regression line multiplied by a value in the range of 0.7 or more and 1.0 or less and that b be set to be from 1 to 5 times the standard deviation which is derived when observation is performed plural times for the same sample.

In the case where coal having a permeation distance corresponding to the range according to (a) through (d) described above is used as material coal for coke (coal for coke making) in a common process, large defects are left and a structure consisting of thin pore walls is formed when coke making is performed, which results in a decrease in coke strength. Therefore, it is simple and effective as a method for achieving coke strength to prepare individual coal brands so that the permeation distance of the coal brands is as small as possible and to use as large amount of such kind of coal brand as possible.

Among methods for preparing coal for coke making of a single brand having a preferable property described above, it is the easiest to blend plural kinds of coal having different permeation distances. The present inventors, from the results of investigations on a permeation distance in the case where plural kinds of coal having different qualities are blended, found that the mean value of permeation distances of the coal weighted by the blending ratios of the coal is virtually equal to the observed value of the permeation distance of the coal blend and completed a method for adjusting the permeation distance of coal for coke making. However, it is preferable that the permeation distance of the coal blend be finally determined by the observed value, because there are inevitable variability among weighted mean values and observed values, and, in the case where the observed permeation distance is out of the range according to the present invention, it is acceptable to control the permeation distance by further adding a coal brand having a smaller permeation distance or, if possible, by decreasing the blending ratio of a coal brand having a large permeation distance.

In addition, a permeation distance of coal can also be decreased and adjusted by heating the coal in the air or by leaving the coal at room temperature for a long time. This kind of treatment is called oxidization or weathering of coal, in which a permeation distance of coal for coke making can be decreased by changing a degree of oxidization by controlling the oxidization conditions such as a temperature, a treating time and a content of oxygen. Although, up to now, it has been understood that oxidization of coal is an unfavorable phenomenon which causes a decrease in caking property, it is a great advantage of the present invention that it has been found that it is possible to decide a preferable degree of oxidization by using a permeation distance which is a novel property and to improve quality of coal by controlling a degree of oxidization. In addition, it has been found that a permeation distance can be decreased by a heating treatment at a temperature of 250° C. or higher even in the absence of oxygen.

It is generally known that a progression rate of weathering of coal depends on a content of oxygen, a pressure (atmospheric pressure), a temperature, a particle size of coal, a water content of coal and so forth. It is appropriate that the factors for weathering described above are controlled as needed when coal is weathered in order to control the values of a permeation distance and maximum fluidity.

The present inventors conducted experiments in which coal is weathered by changing the factors for weathering described above and found that decreasing rates of a permeation distance and a maximum fluidity depend on conditions of weathering. The specific method for that will be described hereafter.

It is necessary that an atmosphere in which weathering is performed be an oxidizing atmosphere. Here, an oxidizing atmosphere refers to an atmosphere which contains oxygen or a material having ability of dissociating oxygen and of oxidizing. Although there are innumerable examples of such conditions, a gas atmosphere containing $O_2$, $CO_2$ and $H_2O$ is preferable. By using a gas atmosphere, it is easy to adjust oxidizing power by controlling a content of an oxidizing gas and a pressure and it is possible to arbitrarily set a treating time, because the progression of oxidization can be stopped without delay by replacing the atmosphere by inert gas after the treatment has been performed. Here, the higher the content of oxidizing gas is and the higher the pressure is, the higher the progression rate of weathering. On the other hand, an atmosphere of oxidizing liquid is not preferable from the viewpoint of controlling the progression of weathering, because it is difficult to separate the liquid from coal and a caking additive immediately after a weathering treatment has been performed.

In addition, an oxidizing atmosphere which can be obtained at the lowest cost, the most easily and in the largest amount is air in the atmosphere of the earth. Therefore, it is preferable to use air in the atmosphere of the earth as an oxidizing atmosphere in the case where an industrial treatment in large amount is desired.

A weathering treatment can be performed at any temperature in a range from room temperature at which a weathering phenomenon of coal occurs to a temperature immediately below a temperature at which coal begins softening and melting. A needed treating time is shorter at a higher treating temperature, because a progression rate of weathering is larger at a higher temperature. The present inventors, from the results of investigations on influence of a treatment temperature on the property of weathered coal, found that the ratio of a decreasing rate of a permeation distance of weathered coal to a decreasing rate of maximum fluidity is the larger for the higher treatment temperature. That is to say, it is the more possible for the higher weathering temperature to preferentially decrease the permeation distance of weathered coal with decrease in a maximum fluidity being suppressed as far as possible. Therefore, it has been found that a high temperature and a short time are effective as preferable conditions on a treatment temperature and a treatment time.

On the other hand, in the case where coal is weathered rapidly, there is necessity to take measures to prevent spontaneous combustion such as watering, because there is possibility of spontaneous combustion due to oxidative heat generation. In addition, if a treatment temperature is too high, it is difficult to control properties after weathering has been performed, because a progression rate of weathering is too large. Moreover, as coal begins to emit volatile matter due to pyrolysis at a temperature of around 300° C. or higher, thermal plasticity of coal changes. Furthermore, when a weathering treatment in a temperature range in which volatile matter is emitted is performed, combustible gas exists under a condition in which the gas is heated in an oxidizing atmosphere, which results in there being a danger of explosion.

For the reason described above, it is preferable that a treatment temperature at which weathering is performed be set to be 100° C. or higher and 300° C. or lower and that a treatment time be set to be 1 minute or more and 120 minutes or less. It is the most preferable that a treatment temperature at which weathering is performed be set to be 180° C. or higher and 220° C. or lower and that a treatment time be set to be 1 minute or more and 30 minutes or less.

Incidentally, coal for coke making of a single brand is defined as a unit of coal for coke making which is regarded as a single lot when the coal is received at a coke making factory. The meaning of regarding a coal as a single lot includes expressing the properties of the whole lot by representative analyzed values which is obtained by sampling from the lot, piling up the coal as a single lot at a coal yard, putting the coal in the same coal hopper and dealing with the coal as a single lot or single brand name in a purchasing contract. Therefore, when coal for coke making according to the present invention is prepared, the mixture of coal which is mixed at a stage before the coal is received at a coke making factory is defined as of a single brand, while a treatment such as mixing coal after the coal has been received at a coke making factory is not included in the definition.

As described above, a range of the quality of coal which can be ideally used as a material for coke making has been clarified and preparation of such coal has been made possible by the present invention. It is possible to manufacture coke of high quality by using a material prepared by using the method according to the present invention.

EXAMPLES

Example 1

The permeation distances of 18 kinds of coal and one kind of a caking additive were observed. The properties of the used coal and caking additive are given in Table 1. Here, Ro denotes a vitrinite mean maximum reflectance of coal in accordance with JIS M 8816, log MF denotes a common logarithm of a Gieseler maximum fluidity observed by using a Gieseler plastometer method and volatile matter (VM) and Ash are observed values by using methods for proximate analysis in accordance with JIS M 8812.

TABLE 1

| Coal | — Ro [%] | logM F [log ddpm] | VM [mass %] | Ash [mass %] | Permeation distance [mm] |
|---|---|---|---|---|---|
| Coal A | 0.66 | 3.55 | 43.2 | 5.8 | 8.0 |
| Coal B | 0.67 | 1.00 | 36.6 | 9.0 | 3.3 |
| Coal C | 0.72 | 3.61 | 40.8 | 9.0 | 14.9 |
| Coal D | 0.73 | 2.29 | 36.2 | 8.8 | 8.1 |
| Coal E | 0.75 | 2.32 | 38.1 | 9.7 | 8.0 |
| Coal F | 0.80 | 3.17 | 37.2 | 7.9 | 19.5 |
| Coal G | 0.91 | 3.59 | 33.0 | 7.9 | 19.0 |
| Coal H | 1.02 | 2.48 | 29.1 | 8.6 | 6.3 |
| Coal I | 1.00 | 1.71 | 25.8 | 9.6 | 2.5 |
| Coal J | 1.00 | 2.20 | 27.7 | 10.4 | 4.8 |
| Coal K | 1.03 | 2.97 | 28.2 | 9.6 | 12.1 |
| Coal L | 1.14 | 1.77 | 24.2 | 9.2 | 4.9 |
| Coal M | 1.30 | 1.34 | 21.0 | 9.4 | 1.3 |
| Coal N | 1.31 | 1.26 | 20.4 | 7.3 | 0.9 |
| Coal O | 1.38 | 2.49 | 20.9 | 10.9 | 8.7 |
| Coal P | 1.44 | 2.03 | 21.1 | 9.3 | 7.8 |
| Coal Q | 1.54 | 0.00 | 16.6 | 8.3 | 1.2 |
| Coal R | 1.62 | 0.70 | 18.8 | 9.6 | 3.0 |
| Caking Additive S | — | 4.8 or more | — | less than 1 | 65.0 |

A permeation distance was observed by using the apparatus which is illustrated in FIG. 1. As a high frequency induction heating method was applied as a heating method, a heating unit 8 in FIG. 1 is a high frequency induction heating coil, and graphite, which is a dielectric material, was used as the material of a vessel 3. The diameter of the vessel was 18 mm and the height of the vessel was 37 mm, and glass beads were used as a material having through-holes from the top to the bottom. A coal sample of 2.04 g, which was pulverized into a particle size of 2 mm or less then was vacuum-dried at room temperature, was charged into the vessel 3 and made into a sample 1 by a packing method in which a weight of 200 g was dropped on top of the coal sample with a dropping height of 20 mm for 5 times (the thickness of the sample was 10 mm in this stage). Then, glass beads having a diameter of 2 mm on top of the sample 1 with a thickness of 25 mm. A disc of sillimanite having a diameter of 17 mm and a thickness of 5 mm was placed on top of a layer packed with the glass beads, then a stick of quartz was placed on the disc as a detection stick 13 used for determining the swelling ratio, then, further, a weight 14 of 1.3 kg was placed on the stick of quartz, which means a load exerted on the disc of sillimanite was 50 kPa. Nitrogen gas was used as inert gas, and the sample was heated up to a temperature of 50° C. at a heating rate of 3° C./min. After heating had been performed, cooling was performed in a nitrogen atmosphere, the mass of the glass beads which did not adhere to thermal plastic coal was observed. Here, although the observing conditions described above were decided by the present inventors as preferable observing conditions of a permeation distance, an observing method of a permeation distance is not necessarily restricted to this method.

Incidentally, it is appropriate that the glass beads are placed so that the thickness of the layer packed with glass beads is more than a permeation distance. In the case where a molten material permeates up to top of the glass beads layer when observation is performed, observation is repeated with an increased amount of glass beads. The present inventors have confirmed that the permeation distances of the same kind of samples are the same, only if the thickness of a glass beads layer is more than the permeation distance. Observation was performed by using a larger vessel and an increased amount of glass beads, when observation was performed for a caking additive the permeation distance of which was larger than that of coal.

A permeation distance was defined by a height in a packed stage of the layer of beads which adhered to each other. The relationship between the height in a packed stage and the mass of a layer packed with particles had been obtained in advance in order to derive the height in a packed stage of the glass beads layer from the mass of the glass beads to which thermal plastic coal adhered. The result of that is equation (4) and a permeation distance was derived by using equation (4).

$$L=(G-M)\times H \quad (4),$$

where L denotes a permeation distance [mm], G denotes the mass of the packed glass beads [g], M denotes the mass of the glass beads which do not adhere to each other [g] and H denotes the height in a packed stage per unit weight of the glass beads which were packed into the present experimental apparatus [mm/g].

Figure 5:
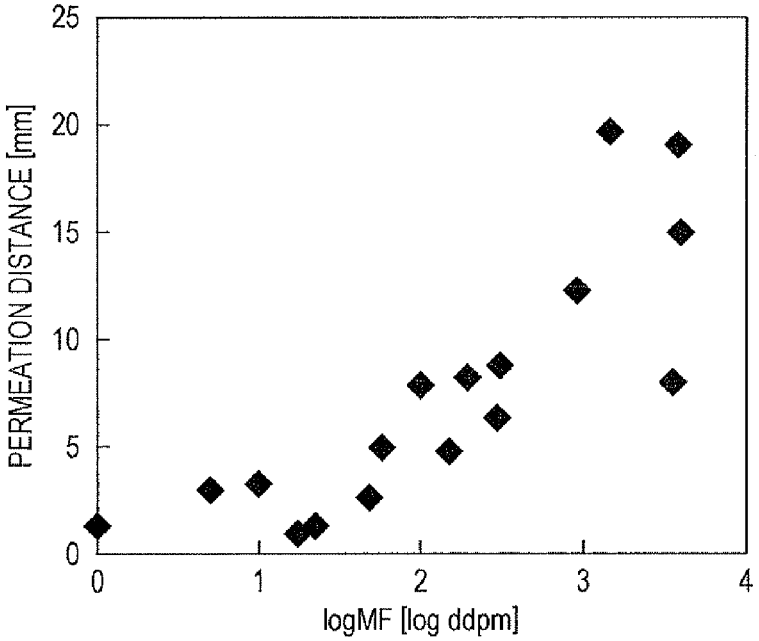
FIG. 5 is a graph illustrating the observed results of a permeation distance of a thermal plastic material of coal.

FIG. 5 illustrates the relationship between the observation results of a permeation distance and the common logarithm (log MF) of the Gieseler maximum fluidity (Maximum Fluidity: MF). Although the correlation between a permeation distance and a maximum fluidity is recognized in FIG. 5, there is a difference between the values of a permeation distance for the same MF. For example, in consideration of the results of investigations on the measurement error of a permeation distance by using the present apparatus, in which the standard deviation derived when tests were performed for three times under the same conditions was 0.6, it was recognized that there is a significant difference in a permeation distance between coal A and coal C which have nearly equal maximum fluidity.

In order to investigate the relationship between coal corresponding to (a) through (d) described above and coke strength, a coal blend containing 20 mass % of coal A which does not correspond to any one of (a) through (d) and a coal blend containing 20 mass % of coal F which corresponds to some of (a) through (d) were made and carbonized, and then the strength of the obtained coke were observed. The blending compositions are given in Table 2.

TABLE 2

| | Blending Ratio (%) | |
|---|---|---|
| Coal | Coal Blend a | Coal Blend f |
| Coal A | 20 | 0 |
| Coal B | 14 | 13 |
| Coal F | 0 | 20 |
| Coal H | 19 | 20 |
| Coal J | 13 | 20 |
| Coal K | 11 | 11 |
| Coal N | 11 | 7 |
| Coal O | 8 | 9 |
| Coal R | 4 | 0 |
| DI150/15(—) | 78.8 | 76.9 |
| CSR (%) | 55.9 | 50.3 |
| MSI + 65(%) | 53.6 | 51.5 |

Here, the simple mean value of the permeation distances of the blended coal kinds was 7.4 mm, and the permeation distance of coal F was 19.5 mm that is 2 times or more the mean value, which means coal F corresponds to (c). In addition, coal F also corresponds to (d), because the permeation distance of coal F is more than 15 mm.

Figure 6:
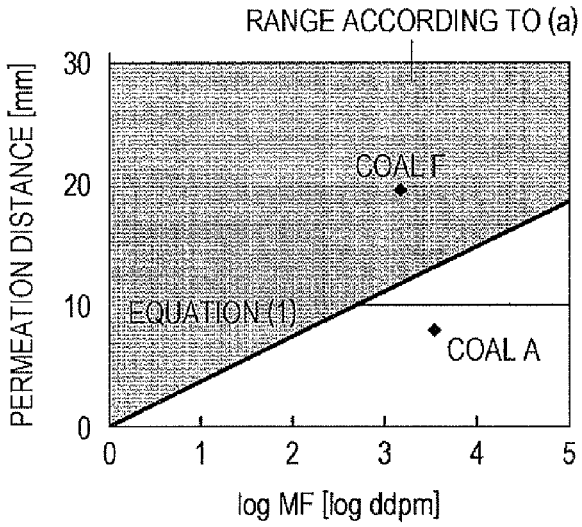
FIG. 6 is a graph illustrating the positional relationship of the permeation distance and the maximum fluidity of coke A and coke F, which were used in Example 1, to the area of a permeation distance and a maximum fluidity corresponding to (a).
Figure 7:
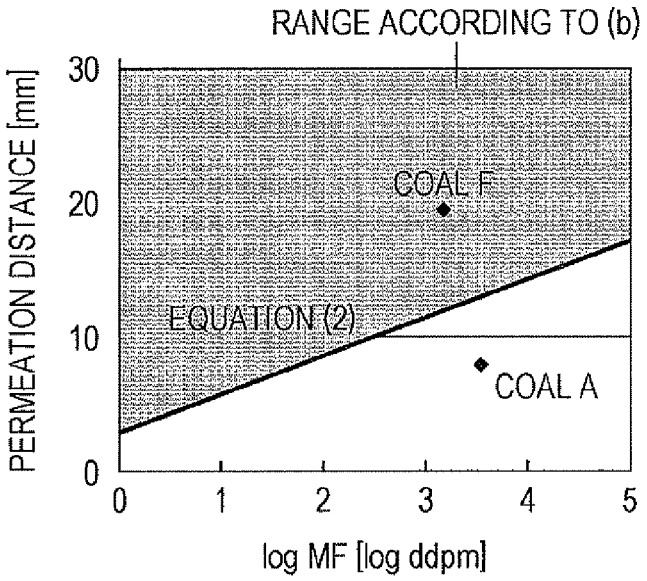
FIG. 7 is a graph illustrating the positional relationship of the permeation distance and the maximum fluidity of coke A and coke F, which were used in Example 1, to the area of a permeation distance and a maximum fluidity corresponding to (b).

In addition, The constants a and a' in equations (1) and (2) were determined as 2.82 which is equal to the slope of the regression line for the values of a permeation distance and maximum fluidity of the coal the value of log MF of which is less than 2.5 among coal A through R. The constant b in equation (2) was determined as 3.0 which is 5 times the standard deviation 0.6 which was obtained under the observation conditions for the examples of the present invention. FIGS. 6 and 7 respectively illustrate the positional relationships of the permeation distance and the maximum fluidity of the caking additive, which were used in the present example, to the area corresponding to (a) and (b). As illustrated in FIGS. 6 and 7, coal F corresponds to both of the area according to (a) and (b). In contrast, coal A does not correspond to any one of (a) through (d).

In the conventional coal blending theory, it has been considered that coke strength is determined mainly by a vitrinite mean maximum reflectance (Ro) and the logarithm of a Gieseler maximum fluidity (log MF) (for example, refer to Non Patent Literature 2). Therefore, coal blends were made by blending various kinds of coal so that the weighted mean value of Ro and the weighted mean value of log MF of all kinds of coal blends were respectively equal (Ro=0.98, log MF=2.3). Here, 2 kinds of coal blends (coal blends a and f) were made by using the coal which was pulverized so that the particle size of 100 mass % of the coal was less than 3 mm. The water content of all kinds of coal blends was adjusted to 8 mass %. 16 kg of the coal blend was compacted into a carbonization can so as to have a bulk density of 750 kg/m$^3$, then the compacted coal blend was heated with a weight of 10 kg placed on top of the packed coal in an electric furnace the wall temperature of which was 1050° C. for 6 hours, then was taken out of the furnace, then cooled in a nitrogen atmosphere and coke was obtained. The strength of the obtained coke was defined, on the basis of a method for testing drum strength in accordance with JIS K 2151, as a drum strength DI150/15 which was obtained as a ratio of the mass of particles having a particle size of 15 mm or more after drum revolution had been performed at a rotational velocity of 15 rpm for 50 rotations with respect to that before rotation was performed.

The observation results of the drum strength of the 2 kinds of coke which were made from coal blends a and f are given in Table 2. CSR (coke strength after reaction in $CO_2$ according to ISO 18894) and micro strength (MSI+65) were also observed. It was confirmed that coal blend f which contained coal F corresponding to some of (a) through (d) was inferior in strength to coal blend a which contained coal A corresponding to none of (a) through (d). Therefore, it was confirmed that the value of a permeation distance observed by the present invention is a factor which has an influence on strength and which cannot be explained by using conventional factors.

As the effectiveness of the estimation of coal by using a permeation distance was confirmed as described above, a method for preparing coal for coke making having a desired permeation distance was investigated. The observed values of a permeation distance of the coal derived from 5 kinds of coal beds of some coal mine were 10.3 mm, 12.3 mm, 15.9 mm, 21.2 mm and 26.8 mm. The observed value of the permeation distance of a mixture (coal for coke making S) consisting of an equal amount of the 5 kinds of coal was 17.9 mm which was nearly equal to the calculated mean value of the 5 values 17.3 mm. The observed value of the permeation distance of a mixture (coal for coke making T) consisting of different amounts of the 5 kinds of coal so that the weighted mean value of a permeation distance was 13.8 mm was 13.1 mm which was also nearly equal to the calculated value. The log MF of coal for coke making S was 4.4 and the log MF of coal for coke making T was 4.3, which means coal for coke making S corresponds to some of (a) through (d) and coal for coke making T corresponds to none of (a) trough (d). As the results of the similar carbonization tests as conducted with coal blend a given in Table 2 by using coal for coke making S or coal for coke making T as an alternative to coal A, coke strength (DI150/15) was 77.5 in the case where coal for coke making S was used and 78.7 in the case where coal for coke making T was used, which means the strength in the case of coal for coke making T was higher by 1.2 points (Table 3). In this example, the result that an effect of increasing strength was the larger in the case where coal for coke making having the smaller permeation distance was used was repeated. From this result, for example, it is possible to prepare coal for coke making having a permeation distance which is adjusted to the desired value by mixing coal derived from various kinds of coal beds, and it is possible to realize an effect of increasing coke strength by appropriately adjusting the permeation distance of coal for coke making.

TABLE 3

| | Coal for Coke Making Substituting for Coal A | |
|---|---|---|
| | S | T |
| Permeation distance (mm) | 17.9 | 13.1 |
| logMF (log ddpm) | 4.4 | 4.3 |
| DI150/15(—) | 77.5 | 78.7 |
| | Comparative Example | Example |

Furthermore, by treating coal for coke making S described above in an atmosphere of air at a temperature of 150° C. for a time of 10 minutes, there was a decrease in a permeation distance down to 14.0 mm (the obtained coal for coke making is to be named coal for coke making U). In addition, by leaving coal for coke making S described above at room temperature in air for a time of 4 months, there was a decrease in a permeation distance down to 14.1 mm (the obtained coal for coke making is to be named coal for coke making V). Here, the log MF of coal for coke making U was 4.0 and the log MF of coal for coke making V was 4.1, which means coal for coke making U and V both correspond to none of (a) through (d). As the results of the carbonization tests as described above by using coal for coke making U or V as an alternative to coal A for coal blend a given in Table 2, coke strength (DI150/15) was respectively 78.4 and 78.2 for coal for coke making U and V (Table 4). In comparison to the case where S was used without oxidization treatment being performed, in which coke strength was 77.5, coke strength was able to be increased by appropriately decreasing a permeation distance. Incidentally, it is necessary to be careful, because an oxidization treatment, in general, causes a decrease in a Gieseler maximum fluidity, and because excessive oxidization causes not only a decrease in a permeation distance down below the specified value but also a decrease in the value of MF, which results in possibility of a decrease in coke strength. Although this kind of decrease in MF can be compensated by treatment such as increasing the blending ratio of other coal having high MF, it may cause an increase in cost. As there is this kind of problem in adjusting a permeation distance by oxidization, it is preferable that an oxidization treatment be performed within an appropriate limit. However, in the case where a permeation distance is adjusted by blending coal from different coal beds, there is not a problem of a decrease in the value of MF, and, consequently, a permeation distance can be adjusted in accordance with quality of coal for coke making to be blended.

TABLE 4

| | Coal for Coke Making Substituting for Coal A | | |
|---|---|---|---|
| | S | U | V |
| Permeation distance (mm) | 17.9 | 14.0 | 14.1 |
| logMF (log ddpm) | 4.4 | 4.0 | 4.1 |
| DI150/15(—) | 77.5 | 78.4 | 78.2 |
| | Comparative Example | Example | Example |

Incidentally, as illustrated in FIG. 5, it is understood that the variability in the correlation between log MF and a permeation distance is large in a range in which log MF is more than 2. In the theory which uses Ro and MF as described above, the weighted mean of log MF of a coal blend is controlled, and a permeation distance is also almost decided by controlling log MF in the case where there is good correlation between MF and a permeation distance. However, as the correlation between MF and a permeation distance is bad in the range of log MF of more than 2, that is to say, MF of more than 100 ddpm, coke strength may vary along with variation in a permeation distance even if log MF is controlled to a specified value. Therefore, it is understood that the method for preparing coal for coke making according to the present invention is more effective in the case where coal of MF of more than 100 ddpm.

REFERENCE SIGNS LIST

1 sample
2 material having through-holes from the top to the bottom
3 vessel
5 sleeve
7 thermometer
8 heating unit
9 temperature detector
10 temperature controller
11 gas inlet
12 gas outlet
13 detection stick used for determining swelling ratio
14 weight
15 displacement sensor
16 circular hole permeating through the body
17 packing particle
18 packing cylinder

The invention claimed is:

1. A method for preparing coal for coke making, the method comprising adjusting a permeation distance of an individual coal brand to a specified value or less when the coal brand is prepared as a material to be used for coke making by itself or by being blended with other coal brands.

2. A method for preparing coal for coke making, the method comprising adjusting a permeation distance of one or more kinds of coal to a specified value or less when plural coal brands are blended as materials to be used for coke making.

3. A method for preparing coal for coke making according to claim 1, the method comprising adjusting the Gieseler maximum fluidity of the coal brand to 100 ddpm or more.

4. A method for preparing coal for coke making according to claim 1, the method comprising defining the specified value of the permeation distance of the coal brand to be prepared by the following equation (1):

$$\text{permeation distance}=1.3\times a\times\log MFc \quad (1),$$

where a is a constant that is 0.7 to 1.0 times a coefficient of log MF obtained by measuring the permeation distance and log MF of at least one of coals that satisfy log MF<2.5 and making a regression line that passes through the origin using the measured values, and where MFc is the Gieseler maximum fluidity (ddpm) of the coal to be prepared.

5. A method for preparing coal for coke making according to claim 4, wherein the a is a constant that is 0.7 to 1.0 times a coefficient of log MF obtained by measuring the permeation distance and log MF of at least one of coals that satisfy 1.75<log MF<2.50 and making a regression line that passes through the origin using the measured values.

6. A method for preparing coal for coke making according to claim 1, the method comprising defining the specified value of the permeation distance of the coal brand to be prepared by the following equation (2):

$$\text{permeation distance}=a'\times\log MFc+b \quad (2),$$

where a' is a constant that is 0.7 to 1.0 times a coefficient of log MF obtained by measuring the permeation distance and log MF of at least one of coals that satisfy log MF<2.5 and making a regression line that passes through the origin using the measured values, where b is a constant defined by the mean value of a standard deviation of a permeation distance or more and the mean value multiplied by 5 or less, when observation is performed plural times for the same sample of one or more kinds selected from the coal brands which are used for deriving the regression line, and where MFc is the Gieseler maximum fluidity (ddpm) of the coal to be prepared.

7. A method for preparing coal for coke making according to claim 6, the a' being a constant that is 0.7 to 1.0 times a coefficient of log MF obtained by measuring the permeation distance and log MF of at least one of coals that satisfy 1.75<log MF<2.50 and making a regression line that passes through the origin using the measured values.

8. A method for preparing coal for coke making according to claim 1, wherein the specified value of the permeation distance is 15 mm according to a value observed when a sample of the coal prepared by pulverizing the coal so that particles having a diameter of 2 mm or less account for 100 mass % and packing a vessel with the pulverized coal at a packing density of 0.8 g/cm$^3$ to a layer thickness of 10 mm is heated to 550° C. at a heating rate of 3° C./min while a load is applied from above glass beads having a diameter of 2 mm placed on the sample so that the pressure is 50 kPa and observing a permeation distance of a thermal plastic sample into the glass beads.

9. A method for preparing coal for coke making according to claim 1, the method comprising determining plural kinds of coal constituting a coal blend in advance and setting the specified permeation distance to be the mean value of the permeation distance of these kinds of coal multiplied by 2 or more.

10. A method for preparing coal for coke making according to claim 1, the method comprising adjusting the permeation distance of individual coal brands to be prepared by blending plural kinds of coal from different places of production.

11. A method for preparing coal for coke making according to claim 1, the method comprising a treatment for decreasing the permeation distance of coal by placing the coal in an atmosphere consisting of one or more of $O_2$, $CO_2$ and $H_2O$ at a temperature of room temperature or higher.

12. A method for preparing coal for coke making according to claim 11, the treatment being performed at a treatment temperature of 100° C. or higher and 300° C. or lower for a treatment time of 1 minute or more and 120 minutes or less.

13. A method for preparing coal for coke making according to claim 12, the treatment being performed at a treatment temperature of 180° C. or higher and 200° C. or lower for a treatment time of 1 minute or more and 30 minutes or less.

* * * * *